US006236373B1

(12) United States Patent
Park

(10) Patent No.: US 6,236,373 B1
(45) Date of Patent: May 22, 2001

(54) VEHICLE SUN VISOR WITH RADIO ANTENNA

(75) Inventor: Young Man Park, Incheon-shi (KR)

(73) Assignee: Humentech 21 Company, Incheon-shi (KR)

( * ) Notice: Subject to any disclaimer, the term of this patent is extended or adjusted under 35 U.S.C. 154(b) by 0 days.

(21) Appl. No.: 09/395,973

(22) Filed: Sep. 15, 1999

(51) Int. Cl.[7] ..... H01Q 1/32

(52) U.S. Cl. ..... 343/713; 343/711; 343/712; 343/806; 343/700 MS

(58) Field of Search ..... 343/806, 713, 343/712, 711, 700 MS; H01Q 1/32

(56) References Cited

U.S. PATENT DOCUMENTS

| | | | | |
|---|---|---|---|---|
| 4,179,540 | * | 12/1979 | Smarook | 428/71 |
| 4,706,273 | * | 11/1987 | Spear et al. | 379/58 |
| 4,870,676 | * | 9/1989 | Lewo | 379/58 |
| 4,894,488 | * | 1/1990 | Gupta | 174/28 |
| 4,998,291 | * | 3/1991 | Marui et al. | 455/89 |
| 5,510,791 | * | 4/1996 | Viertel et al. | 341/173 |
| 5,649,317 | * | 7/1997 | Suzuki | 445/345 |
| 5,649,350 | * | 7/1997 | Lampe et al. | 29/600 |
| 5,686,903 | * | 11/1997 | Duckworth et al. | 340/825.22 |
| 6,016,127 | * | 1/2000 | Casciola et al. | 343/731 |
| 6,067,447 | * | 5/2000 | Zucker | 455/69 |
| 6,069,592 | * | 5/2000 | Wass | 343/895 |
| 6,092,584 | * | 7/2000 | Humphries | 160/370.23 |
| 6,130,385 | * | 10/2000 | Tuunanen et al. | 174/110 PM |

* cited by examiner

*Primary Examiner*—Hoanganh Le
*Assistant Examiner*—Tuyet T. Vo
(74) *Attorney, Agent, or Firm*—Jacobson, Price, Holman & Stern, PLLC

(57) ABSTRACT

A vehicle sun visor, provided with a radio absorptive conductor acting as a radio antenna, is disclosed. The vehicle sun visor, having a panel shape, is installed on the front portion of the interior ceiling within the passenger compartment of a car. The radio absorptive conductor, acting as a radio antenna, is installed on one surface of the sun visor while forming an arrangement suitable for effectively receiving radio waves. The above conductor is also electrically connected to the antenna terminal of an onboard radio system of the car. An input radio wave amplifying unit is mounted on the electric path between the conductor and the antenna terminal of the radio system. The above unit is used for filtering, amplifying and buffering the radio waves received by the conductor. In the present invention, the conductor may be formed by cutting a conductive thin plate into a desirably arranged line through a pressing process. It is also possible to attach the conductor to the surface of the sun visor using an adhesive or a blowing agent. In another embodiment, the conductor is also integrated with the sun visor while being inserted into the visor during an injection molding process of forming the sun visor using a plastic material.

4 Claims, 1 Drawing Sheet

VEHICLE SUN VISOR WITH RADIO ANTENNA

BACKGROUND OF THE INVENTION

1. Field of the Invention

The present invention relates, in general, to vehicle sun visors installed within the passenger compartment of a car and, more particularly, to a vehicle sun visor with a radio absorptive conductor acting as a radio antenna.

2. Description of the Prior Art

As well known to those skilled in the art, cars are conventionally equipped with onboard radio systems and sun visors for allowing people to conveniently and safely drive their cars. It is necessary for such an onboard radio system to be provided with an antenna for improving the reception sensitivity of the system and allowing people to enjoy clear sound quality from the system while driving a car.

Several types of vehicle antennas, for example, telescopic antennas, fixed rod antennas and film antennas, have been proposed and used.

Such a telescopic antenna is conventionally installed on a fender of a car, while such a fixed rod antenna is exteriorly installed on the roof, the rear window panel or the chassis of a car. The conventional film antenna is formed by coating a line-shaped conductive material in a zigzag arrangement on the interior surface of a windshield, a rear window panel, or a window glass.

The above-mentioned vehicle antennas individually have advantages and problems as follows.

That is, the fixed rod antenna is inexpensive in the manufacturing cost. However, such an antenna spoils the appearance of a car and may be easily broken since it is always exposed to the outside of the car.

On the other hand, the telescopic antenna is designed to telescopically extend from a fender when it is used and to be fully retracted into the fender when it is not used. The telescopic antenna is thus advantageous in that it is free from spoiling the appearance of a car. However, this type of antenna is problematic in that it forces a designer to necessarily consider the position and space for the antenna while designing a car since the antenna has to be installed on a fender while accomplishing a telescopic structure. It is also necessary for the telescopic antenna to be provided with a fixing structure, such as a mount bracket. Such a fixing structure in addition to the telescopic structure for the antenna increases the manufacturing cost of the antenna and complicates the process of manufacturing a car. The complicated process of manufacturing a car finally increases the assembling cost of the car.

Another problem of the telescopic antenna resides in that the telescopic structure of the antenna may be easily broken. When the antenna is fully extended outside a fender, the antenna may be unexpectedly broken in the same manner as that described for the fixed rod antenna. When the telescopic antenna is unexpectedly broken, it is necessary to completely replace the broken antenna with a new antenna incurring extra expense on the owner. This finally increases the maintenance cost of the antenna.

Since the film antenna is provided within the passenger compartment of a car, the antenna is not easily broken due to external impact and is free from spoiling the appearance of the car. However, it is necessary for the film antenna to be precisely coated on a glass in a desired arrangement. Therefore, this type of antenna is expensive. Another problem of the film antenna resides in that the antenna may be broken when a glass coated with the film antenna is broken.

In addition, sun visors, installed on the front portion of the interior ceiling within the passenger compartment of a car, are used for shielding the eyes of a driver from direct sunlight or glare.

Of course, a variety of sun visors have been proposed. Such visors may be appropriately selected by users in accordance with models of cars. However, most visors comprise longitudinal rigid panels and are designed to be rotatably mounted to the front portion of the interior ceiling at positions around the top edge of a windshield.

Such known sun visors are originally designed to effectively shield the eyes of a driver from direct sunlight or glare as described above, but may be provided with a clip capable of clipping a small-sized sheet material or with a mirror for allowing a driver to collaterally use it. However, the use of the sun visors is undesirably limited, and so it is necessary for designers to make the visors to be more effectively and more widely used in addition to the original use of the visors.

SUMMARY OF THE INVENTION

Accordingly, the present invention has been made keeping in mind the above problems occurring in the prior art, and an object of the present invention is to provide a vehicle sun visor, which is provided with a radio absorptive conductor acting as a radio antenna, the antenna being inexpensive in the manufacturing cost, being easily installed on the sun visor, being free from easy breakage and being free from spoiling the appearance of a car.

In order to accomplish the above object, the present invention provides a vehicle sun visor having a panel shape and being installed on a front portion of the interior ceiling within a passenger compartment of a car, further comprising: a radio absorptive conductor installed on one surface of the sun visor while forming an arrangement suitable for effectively receiving radio waves, the conductor being electrically connected to the antenna terminal of an onboard radio system of the car, thus acting as a radio antenna.

In the above vehicle sun visor, an input radio wave amplifying unit is mounted on the electric path between the conductor and the antenna terminal of the radio system and is used for filtering, amplifying and buffering the radio waves received by the conductor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
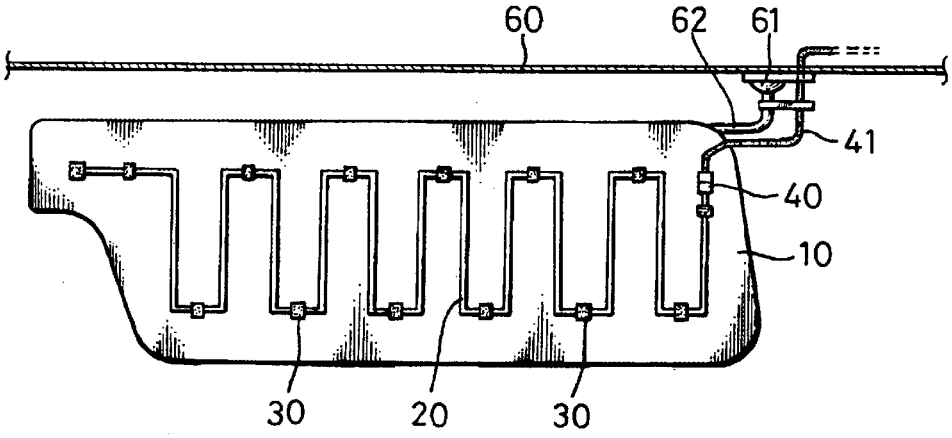
FIG. 1 is a view, showing the construction of a sun visor with a radio antenna in accordance with the preferred embodiment of the present invention.

FIG. 1 is a view, showing the construction of a sun visor with a radio antenna in accordance with the preferred embodiment of the present invention.

As shown in the drawing, the vehicle sun visor 10, having a longitudinal panel shape, is rotatably installed on the front portion of the interior ceiling 60 using both a fixing hinge 61 and a rotatable shaft 62 within the passenger compartment of a car.

A radio absorptive conductor 20 is installed on one surface of the sun visor 10 while forming a zigzag line shape suitable for effectively receiving radio waves. In the preferred embodiment, the conductor 20 in the form of zigzag line is firmly attached to the visor 10 at several points using a blowing agent 30. One end of the conductor 20 is electrically connected to a shield wire 41 of an input radio wave amplifying unit 50 through a connector 40.

Figure 2:
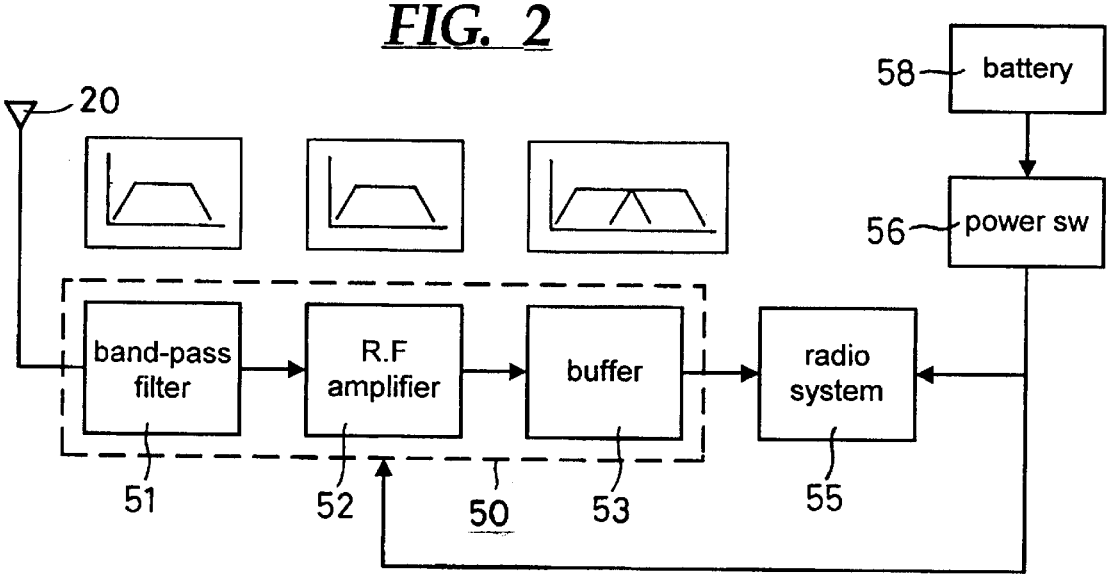
FIG. 2 is a block diagram, showing the construction of an electric circuit integrated with both the antenna of this invention and an onboard radio system.

FIG. 2 is a block diagram, showing the construction of an electric circuit integrated with both the antenna and an onboard radio system. As shown in the drawing, the input radio wave amplifying unit 50 is designed to be selectively activated by electric power from an onboard battery 58 when the power switch 56 of an onboard radio system 55 is turned on. The input radio wave amplifying unit 50 comprises a bandpass filter 51, an R.F. (radio frequency) amplifier 52 and a buffer 53. The band-pass filter 51 is used for transmitting the input radio waves, received by the conductor 20, in a desired frequency band. The R.F. amplifier 52 amplifies the filtered waves from the band-pass filter 51, thus forming amplified signals. On the other hand, the buffer 53 is used for buffering the amplified signals prior to transmitting the signals to an antenna terminal of the radio system 55.

In the operation of the above sun visor 10, the conductor 20 in the form of zigzag line, set on the visor 10, always receives radio waves. The input radio waves from the conductor 20 are transmitted to the input radio wave amplifying unit 50 through both the connector 40 and the shield wire 41 prior to being transmitted to the antenna terminal of the onboard radio system 55.

When a driver turns on the power switch 56 of the radio system 55, electric power of the onboard battery 58 is applied to the input radio wave amplifying unit 50.

When the input radio wave amplifying unit 50 is activated by the electric power from the battery 58, the band-pass filter 51 transmits the input radio waves in a desired frequency band. The R.F. amplifier 52 amplifies the filtered waves from the band-pass filter 51. The amplified waves from the R.F. amplifier 52 are, thereafter, buffered by the buffer 53, thus becoming effective waves suitable for being used by the radio system 55 and being transmitted to the antenna terminal of the radio system 55.

Of course, it should be understood that the construction of the sun visor with the radio antenna of this invention may be altered in accordance with the characteristics of both the visor and the conductor without affecting the functioning of this invention.

For example, the conductor of this invention may be made of materials having a high radio absorptivity. In an effort to improve the radio absorptivity of the conductor, a line-shaped conductor, having a desired length, may be preferably arranged on the visor into a flat arrangement, such as a zigzag arrangement, a comb arrangement or a multi-row loop arrangement. One the other hand, such a line-shaped conductor may be also arranged on the visor into a stereo arrangement, such as a coil arrangement.

In another embodiment of the invention, the conductor may be formed by cutting a conductive thin plate into a desirably arranged line through a pressing process. In such a case, it is possible to simplify the process of manufacturing such conductors while reducing the manufacturing cost of the conductors. This finally allows the sun visor with conductors to be produced in commercial quantity.

In the present invention, the conductor may be attached to the surface of the sun visor using an adhesive or a blowing agent. The conductor may be also integrated with the sun visor while being inserted into the visor during an injection molding process of forming the sun visor using a plastic material.

In addition, the conductor may be attached to a separate member assembled with the sun visor.

As described above, the present invention provides a vehicle sun visor, provided with a radio absorptive conductor acting as a radio antenna.

The antenna is provided on the sun visor installed in the passenger compartment of a car, and so the antenna is not exposed to the outside of the car. Therefore, the antenna, set in the visor, is not easily broken and is free from spoiling the appearance of a car different from conventional antennas always exposed to the outside of a car.

The antenna of this invention, provided on a vehicle sun visor, is thus remarkably reduced in the manufacturing cost in comparison with conventional telescopic antennas, conventional fixed rod antennas, and conventional film antennas. The antenna of this invention is also easily and simply installed on a car without using any additional mounting structure or considering a positional relation between the antenna and the parts of a chassis. When the antenna of this invention is unexpectedly broken, it is possible to easily repair the antenna or to easily change the antenna with a new one without disassembling the parts of the chassis.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vehicle sun visor having a panel shape and being installed on a front portion of an interior ceiling within a passenger compartment of a car, further comprising:

a radio absorptive conductor installed on a surface of said sun visor while forming an arrangement suitable for effectively receiving radio waves, said conductor being electrically connected to an antenna terminal of an onboard radio system of the car, and acting as a radio antenna; and said conductor is integrated with the sun visor while being inserted into the sun visor during an injection molding process of forming the sun visor using a plastic material.

2. The vehicle sun visor according to claim 1, further comprising:

an input radio wave amplifying unit mounted on an electric path between the conductor and the antenna terminal of the radio system and used for filtering, amplifying and buffering the radio waves received by the conductor.

3. The vehicle sun visor according to claim 1, wherein said conductor is formed by cutting a conductive thin plate into a desirable arranged line through a pressing process.

4. The vehicle sun visor according to claim 1, wherein said conductor is attached to a separate member assembled with said sun visor.

* * * * *